United States Patent [19]

Brady et al.

[11] Patent Number: 4,523,543

[45] Date of Patent: Jun. 18, 1985

[54] ASPHALT SHINGLES - COLOR BLEND DROP SEQUENCE RANDOMIZED BY DEPOSITION MEANS CONTROLLED BY RANDOM SIGNAL GENERATOR TO OBVIATE STRIPES ON ROOF

[75] Inventors: Thomas R. Brady; Lester C. Benner, both of Newark, Ohio

[73] Assignee: Owens-Corning Fiberglas Corporation, Toledo, Ohio

[21] Appl. No.: 567,589

[22] Filed: Jan. 3, 1984

[51] Int. Cl.[3] ..... B05B 12/02

[52] U.S. Cl. ..... 118/697; 118/702; 118/696; 427/188; 427/197; 427/204

[58] Field of Search ..... 118/696, 706, 697, 699, 118/679, 684; 222/37, 52; 427/186, 187, 188, 197, 204

[56] References Cited

U.S. PATENT DOCUMENTS

| | | | |
|---|---|---|---|
| 3,593,308 | 7/1971 | Fagan | 118/697 |
| 3,653,543 | 4/1972 | Preikschat | 222/52 |
| 3,785,898 | 1/1974 | Gerber et al. | 118/697 |
| 3,825,185 | 7/1974 | Moon et al. | 118/697 |
| 4,164,001 | 8/1979 | Patnaude | 118/684 |
| 4,448,821 | 5/1984 | Buschor | 118/697 |

*Primary Examiner*—Shrive P. Beck

*Attorney, Agent, or Firm*—Ronald C. Hudgens; Ted C. Gillespie

[57] ABSTRACT

Apparatus for depositing granules comprising feeders adapted to discharge responsive to a signal transmitter, the reception of the signal being interrupted by a moving tape, a plurality of such apparatus being employed to eliminate patterning on roofing shingles. A random signal generator may be used.

4 Claims, 1 Drawing Figure

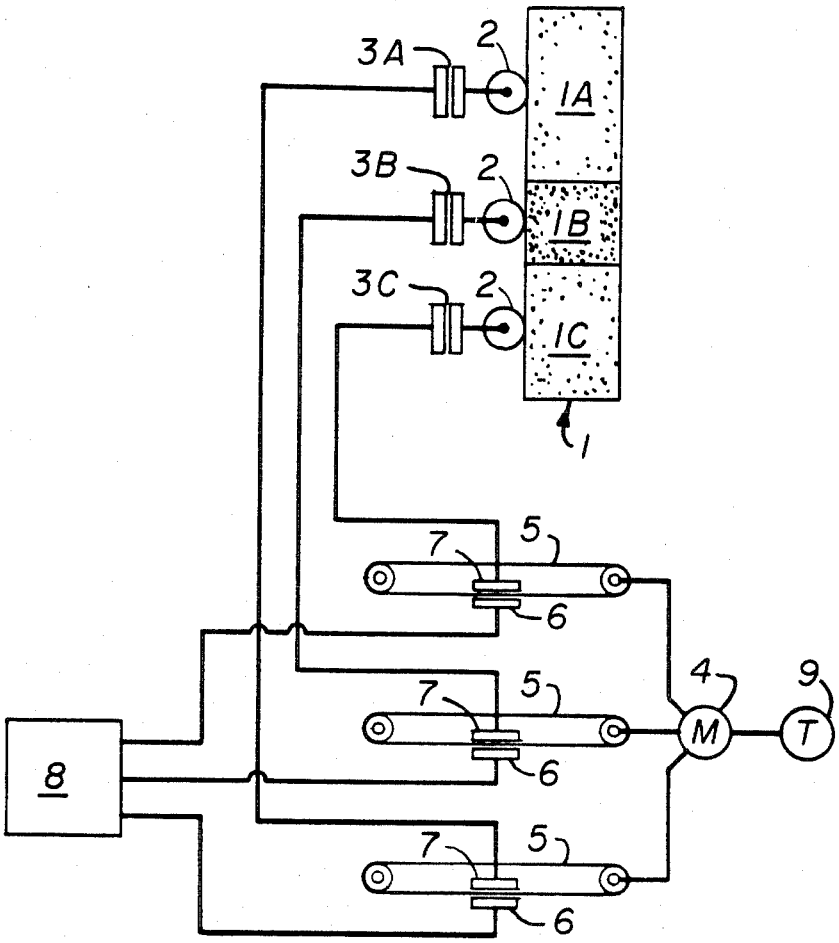
3A
2
1A
3B
2
1B
3C
2
1C
1
5
7
6
5
7
6
5
7
6
4
9
M
T
8

ASPHALT SHINGLES - COLOR BLEND DROP SEQUENCE RANDOMIZED BY DEPOSITION MEANS CONTROLLED BY RANDOM SIGNAL GENERATOR TO OBVIATE STRIPES ON ROOF

TECHNICAL FIELD

This invention relates to the production of asphalt shingles.

In one of its more specific aspects, this invention relates to deposition of granules on asphalt shingles in random depositions.

BACKGROUND OF THE INVENTION

The production of asphalt shingles of various colors is well known. Generally, such shingles are colored by applying a mixture of colored granules to a moving, asphalt covered sheet. The application of the granules is made from a series of granule containers by means of feed rolls. The length and spacing of each mixture on the sheet is known as a "drop" and is dependent on the speed of the feed roll, the relative speed of the sheet and the length of time during which the drop is made.

In normal granule application, a fixed blend cycle is employed. Such a cycle is repetitive and can be altered only with difficulty. As a result, there frequently results an undesirable "patterning" on the roof upon application to the surface on which the shingles are laid. Under certain application conditions varying with the cycle length, the drops are visible on the laid shingles as bands or stripes on the roof. The longer the cycle or the less contrast between drops in the blend, the less apparent the patterning will be, but it is almost always present.

The apparatus of this invention is directed to the solution of that problem.

STATEMENT OF THE INVENTION

According to this invention, there is provided a particulate applicator which comprises a signal generator, a signal emitter connected to the generator, a sensor receptive to the signal transmitted by the signal emitter, the transfer of said signal being interrupted by a moving tape, a brake-clutch mechanism responsive to the sensors and adapted to actuate after-defined feed means, and feed means adapted to distribute particulate material onto a substrate.

In one embodiment of this invention, the tape is driven by drive means inter-related to the line speed of the surface receptive to the deposition of the granules.

DESCRIPTION OF THE DRAWINGS

The drawing is a schematic representation of the apparatus of this invention.

DETAILED DESCRIPTION OF THE INVENTION

The apparatus of this invention provides intermittent signals from a signal emitter to a signal sensor through a driven tape. The signals can be either optical or magnetic. The speed of the tape is proportional to the speed of the roofing line.

In order to make the granule application random, the signal emitter is energized on a random basis. For each feed roll there is provided an individual signal sensor, tape and signal emitter, with any suitable number of particle feed rolls being employed.

Referring now to the FIGURE, there is shown compartmentalized blend box 1 comprising any suitable number of compartments 1A, 1B and 1C, each of which is adapted to operate as described for compartment 1A whose operation, alone, will be described. The blend box is adapted to contain particulate material which is discharged from the box onto the fluted roll 2 from which, upon rotation, the particulate material is discharged onto the shingle substrate.

The roll is driven by means of a drive, not shown, the roll being positioned in the drive or non-drive position by means of brake-clutch mechanisms 3A, 3B and 3C. The brake-clutch mechanism, in turn, is engaged upon receipt of a signal from sensor 7.

The sensor receives a signal, to which it is responsive, from signal emitter 6. This signal can be of any suitable characteristic, such as optical or magnetic, which signal is generated by random signal generator 8. Interposed between the individual signal emitter and the sensor is tape 5 which is encoded to reflect the blend cycle, the length and frequency of the particulate drop, the sequence of the drop, and so forth, similar characteristics of the tape being interrelated with the other related and similar mechanisms in the same system to provide the desired integration of drops between the plurality of feed rolls. Each of the feed rolls, has a separate signal sensor, tape and signal emitter.

The tape is driven by any suitable drive means, not shown, so that at predetermined intervals a signal is received by sensor 7 from the optical or magnetic signal emitter 6. Emitter 6, in turn, receives a signal from random signal generator 8.

In one embodiment of this invention, the tape is driven by a drive means, indicated in the drawing by motor 4, which is inter-related to the line speed of the surface receptive to the deposition by means of line speed tachometer 9.

A specific blend pattern can be substituted for a random application by operating the signal generator on a constant, rather than intermittent basis. The length of the blend cycle can then be altered by changing the length of the tape or distance between repetitive tape patterns with the lengths of drop being changed, in a similar manner, by altering tape patterns.

The random application possible by the apparatus of this invention disguises differences in light reflection caused by variations in granule press. The major problem associated with patterned blends is that in any repetitive cycle, the same drop will repeat on a regular basis. Under certain application conditions, the drops are visible as bands or stripes on the roof.

The present invention provides random application of these blend drops. The system uses neither a cam nor a micro-switch arrangement nor camless limit switches. Instead, there is employed the magnetic or perforated tape with the appropriate sensor. There can be one tape for each blend drop and the length of the coding to which the rolls respond can be proportionate to the desired drop length. The sensors are actuated at random by the random pulse generator so that no blend repetition occurs and there is no imposed cycle length. If a repetitive pattern blend is desired, tapes so encoded can be substituted and the sensors can be operated repetitively. The apparatus of the present invention permits an infinite variety of blend cycles, or no blend cycle at all, depending on the encoding of the tape.

It will be evident from the foregoing that various modifications can be made to the apparatus of this invention. Such, however, are considered within the scope of the invention.

We claim:

1. Apparatus for depositing granules onto a moving substrate comprising:

(a) a random signal generator;

(b) a signal emitter actuated by said random signal generator;

(c) a sensor receptive to signals emitted by said signal emitter;

(d) a granule container;

(e) discharging means for discharging granules from said granule container; and (f) means for actuating said discharging means responsive to signals from said sensor.

2. The apparatus of claim 1 in which the reception of signals from said signal emitter is interrupted by a moveable tape means.

3. The apparatus of claim 2 in which the movement of said tape means is inter-related to the movement of said moving substrate.

4. The apparatus of claim 1 in which said discharging means comprises a fluted roll, and in which said means for actuating comprises a brake-clutch mechanism.

* * * * *